US010626587B2

(12) United States Patent
McAlpine et al.

(10) Patent No.: US 10,626,587 B2
(45) Date of Patent: Apr. 21, 2020

(54) OVERFLOW

(71) Applicant: McAlpine & Co. Ltd., Glasgow, Strathclyde (GB)

(72) Inventors: James Edward McAlpine, Paisley (GB); Christopher McKendrick, Glasgow (GB); Robert Gemmell McAlpine, Glasgow (GB)

(73) Assignee: MCALPINE & CO. LTD., Glasgow (GB)

( * ) Notice: Subject to any disclaimer, the term of this patent is extended or adjusted under 35 U.S.C. 154(b) by 49 days.

(21) Appl. No.: 15/759,128

(22) PCT Filed: Aug. 30, 2016

(86) PCT No.: PCT/GB2016/052678
§ 371 (c)(1),
(2) Date: Mar. 9, 2018

(87) PCT Pub. No.: WO2017/042537
PCT Pub. Date: Mar. 16, 2017

(65) Prior Publication Data

US 2019/0055723 A1 Feb. 21, 2019

(30) Foreign Application Priority Data

Sep. 9, 2015 (GB) ..... 1515953.6

(51) Int. Cl.
*E03C 1/232* (2006.01)

(52) U.S. Cl.
CPC ..... *E03C 1/232* (2013.01)

(58) Field of Classification Search
CPC ..... E03C 1/232; E03C 1/24
USPC ..... 4/597
See application file for complete search history.

(56) References Cited

FOREIGN PATENT DOCUMENTS

| | | | | |
|---|---|---|---|---|
| EP | 1593784 | | 11/2005 | |
| EP | 1593784 | A2 * | 11/2005 | ..... E03C 1/232 |
| EP | 2037051 | | 3/2009 | |
| WO | 2014087151 | | 6/2014 | |

OTHER PUBLICATIONS

EP 1593784 (Year: 2005).*
"International Search Report and Written Opinion", PCT Application No. PCT/GB2016/052678, dated Dec. 2, 2016, 10 pages.
"Preliminary Report on Patentability", PCT Application No. PCT/GB2016/052678, dated Mar. 22, 2018, 9 pages.

* cited by examiner

*Primary Examiner* — Lauren A Crane
(74) *Attorney, Agent, or Firm* — Colby Nipper PLLC

(57) ABSTRACT

An overflow device for an appliance such as a bathtub, sink or the like. The overflow device comprises a body which connects the overflow device to the appliance. The body includes a body inlet adapted to be connected to an appliance outlet. The body also includes a body outlet adapted to be connected to a soil stack. A drainage flowpath is defined between the body inlet and the body outlet. In use, the drainage flowpath creates a water seal between the body inlet and body outlet. The overflow device also includes a pipe arrangement in fluid communication with the body, where the pipe arrangement defines an overflow flowpath between the body inlet and the body outlet, such that, in use, at least a portion of the overflow flowpath is beneath the level of the water seal.

20 Claims, 5 Drawing Sheets

OVERFLOW

FIELD OF THE INVENTION

This invention relates to an overflow device for use with sinks, baths and other sanitary appliances.

BACKGROUND TO THE INVENTION

A sink or bath conventionally has an overflow which determines the maximum level to which water can rise in the sink bowl. Usually, the overflow is in the form of an opening in the wall of the bowl, the opening being connected to the waste pipe either by means of a channel formed in the body of the sink itself or by means of a flexible hose interconnecting an overflow terminal and a terminal on the waste system.

Such overflow systems are simple and well understood, but they do have some disadvantages. An overflow channel within the sink body adds complexity to the structure and to the manufacturing process. A separate flexible hose arrangement uses a number of components and can be awkward to install and maintain. In addition, the waste opening in the wall of the sink bowl presents potential hygiene problems and can be difficult to clean.

It has hitherto been proposed to provide an overflow which is concealed, in the sense that there is no overflow opening in the wall of the bowl, and no overflow arrangement is visible to the user. Prior proposals, however, have relied on the use of valves in various forms, with consequent complexities in manufacture and potential reliability problems.

Additionally, the requirement for a water seal and to the height of the construction in the space, particularly when you're talking about baths is particularly limited. Furthermore there is also issues associated with drainage of these devices, and particularly the speed of drainage, due to the complicated construction.

SUMMARY OF THE INVENTION

According to a first aspect of the present invention there is provided an overflow device for an appliance such as a bathtub, sink or the like, the overflow device comprising:

- a body, the body defining a body inlet adapted to be connected to an appliance outlet; a body outlet adapted to be connected to a soil stack; and a drainage flowpath between the body inlet and the body outlet, wherein the drainage flowpath, in use, creates a water seal between the body inlet and body outlet; and
- a pipe arrangement in fluid communication with the body, the pipe arrangement defining an overflow flowpath between the body inlet and the body outlet, such that, in use, at least a portion of the overflow flowpath is beneath the level of the water seal.

In at least one embodiment of the present invention, the overflow device provides a method of providing a compact solution to the requirements of customers for low clearance baths, for example. By having the water seal at a level which is as high as or higher than the overflow flowpath, the height of the body outlet can be raised thereby reducing the overall height of the body.

Conventional systems which utilise a downstream water seal have a significantly greater depth when all the components are assembled than the present invention due to the positioning of the water seal.

The body is connected to the pipe arrangement at a pipe arrangement entry and a pipe arrangement exit.

The body may comprise an inlet chamber, the inlet chamber being in fluid communication with the body inlet, and an outlet chamber, the outlet chamber being in fluid communication with the body outlet, wherein the pipe arrangement is connected to the body such that a pipe arrangement entry is associated with the inlet chamber and a pipe arrangement exit is associated with the outlet chamber and wherein the pipe arrangement is in continuous fluid communication with the inlet chamber and the outlet chamber.

An upper portion of the pipe arrangement may define an inverted U shape.

The inverted U-shaped portion of the pipe arrangement may be arranged relative to the appliance to which it is attached such that fluid level in the pipe arrangement equates to a level of fluid in the appliance and such that when a predetermined level of water in the appliance is reached, the inverted U-shaped portion provides an overflow function, wherein fluid flows from the inlet chamber into the pipe arrangement entry, through the pipe arrangement and to the outlet chamber through the pipe arrangement exit.

At least part of the pipe arrangement may be adjustable such that the predetermined level can be raised or lowered.

In at least one embodiment, the pipe arrangement is telescopic.

The overflow device may further comprise a sealing member configured to separate the inlet chamber from the outlet chamber, wherein the sealing member defines an aperture, wherein the drainage flowpath is defined when the aperture is open; wherein the sealing member incudes an edge, which forms a seal seat adapted to cooperate with sealing means to form a barrier across the drainage flowpath thereby preventing fluid flow between the inlet chamber and the outlet chamber.

The sealing means may be selectively activated such that when activated the sealing means cooperates with the seal seat to close the aperture such that the appliance can be filled to a predetermined level and when deactivated the sealing means moves from contact with the seal seat such that the appliance can be emptied.

The sealing means may be selectively activated and deactivated via the body inlet chamber.

By deactivating the sealing means, fluid in the appliance flows through the body inlet along the drainage flowpath and out the body outlet to the soil stack.

The sealing means may be adapted to engage a body sealing member.

The sealing means may comprise a pop-up plug, which incorporates a sealing gasket operable to cooperate with the seal seat to selectively activate and deactivate the sealing function of the sealing means.

The body outlet may be oriented at an angle to the horizontal.

The body outlet may be vertical.

The water seal level may be defined by the lowest part of the outlet.

At least a portion of the overflow flowpath may be positioned lower than the lowest part of the outlet.

At least a portion of the pipe arrangement exit may be positioned lower than lowest part of the outlet.

The whole of the pipe arrangement exit may be positioned lower than the lowest part of the outlet.

The depth or height of the water seal is defined by the height of the lowest part of the body outlet.

BRIEF DESCRIPTION OF THE DRAWINGS

An embodiment of the invention will now be described with reference to the accompanying drawings, in which.

DETAILED DESCRIPTION OF THE DRAWINGS

Figure 1:
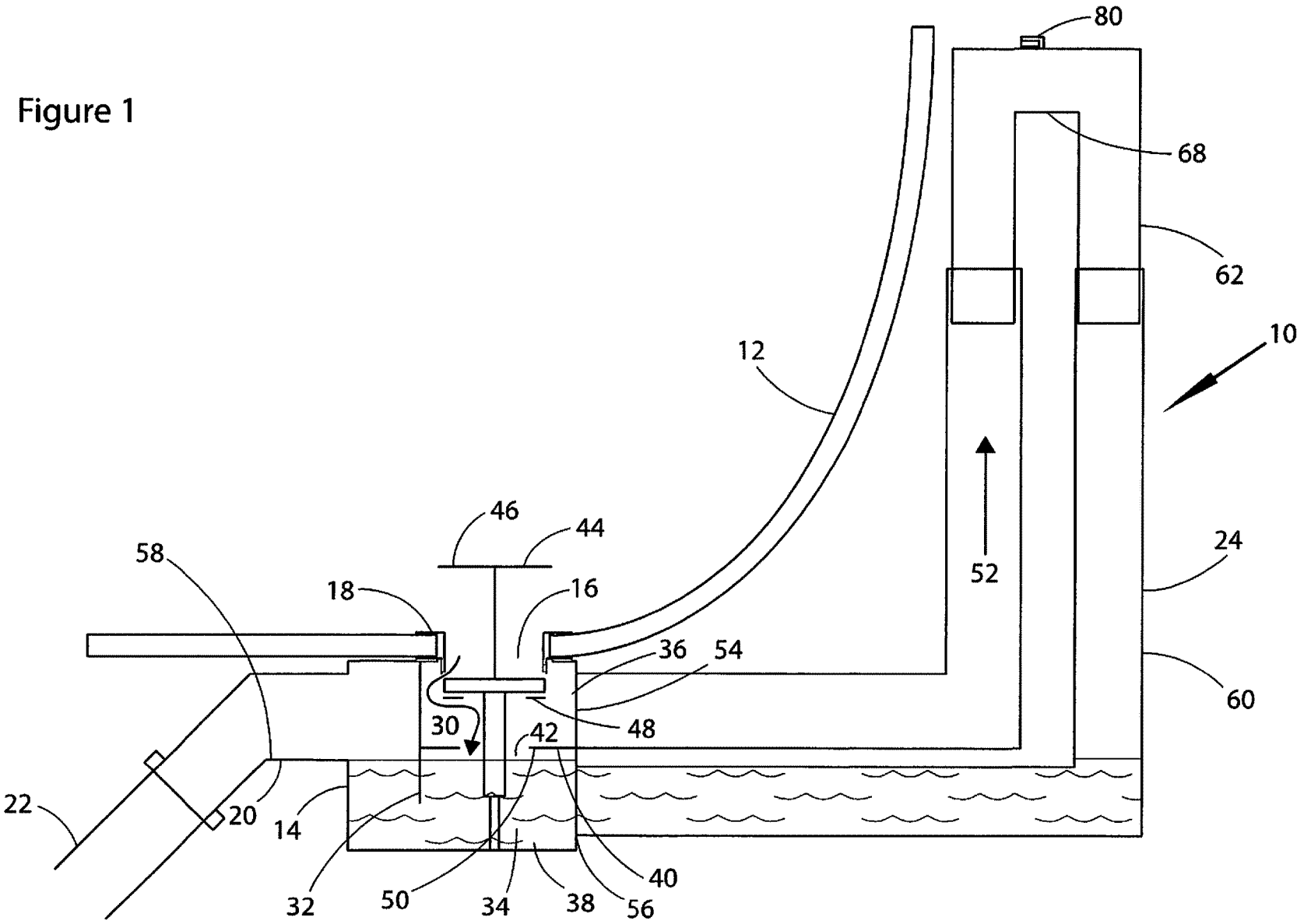
FIG. 1 is a side section schematic of an overflow device in accordance with an embodiment of the present invention.
Figure 2:
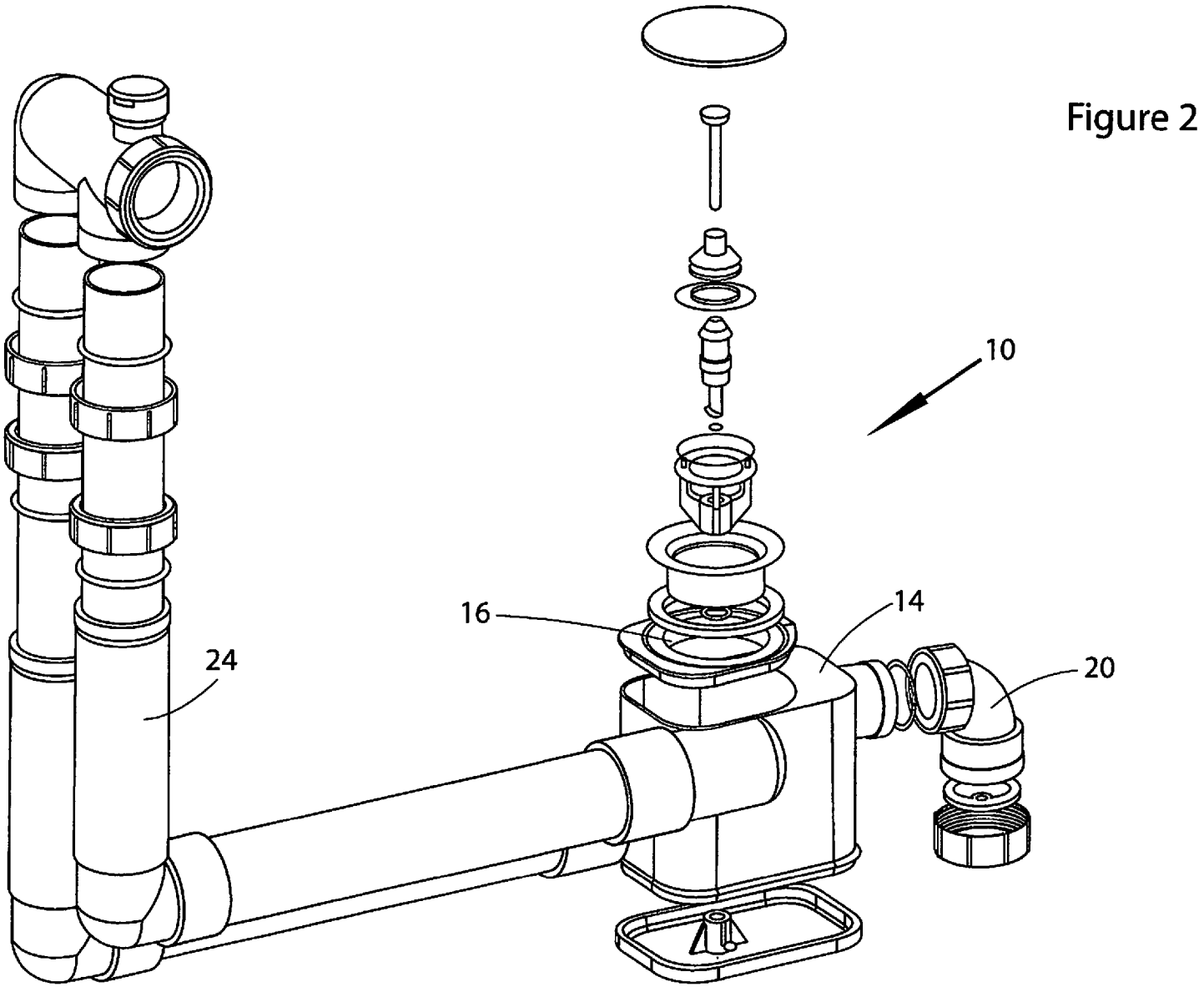
FIG. 2 is a perspective view of the overflow device of FIG. 1.

Reference is first made to FIG. 1, a side section schematic of an overflow device, generally indicated by reference numeral 10, for a bath 12 and FIG. 2, an exploded perspective view of the overflow device of FIG. 1, in accordance with an embodiment of the present invention.

The overflow device comprises a body 14 defining an inlet 16 adapted to be connected to a bath outlet 18 and the body outlet 20 adapted to be connected to a soil stack 22. The body 14 defines a drainage flowpath 30 between the body inlet 16 and the body outlet 20, the drainage flowpath 30 being convoluted around a drainage flowpath separator 32 such that, in use, a water seal 34 is formed in the body 14. In this embodiment, the height of the water seal 34 is determined by the lowest level 58 of the body outlet 20.

As can be seen, particularly from FIG. 1, the body further comprises an inlet chamber 36 in fluid communication with the body inlet 16, and an outlet chamber 38 in fluid communication with the body outlet 20. Separating the inlet chamber 36 from the outlet chamber 38 is a body sealing member 40 which defines an aperture 42 through which fluid can flow from the inlet chamber 36 to the outlet chamber 38.

The overflow device 10 further comprises a sealing means 44 in the form of a pop-up plug 46. The pop-up plug 46 incorporates a sealing gasket 48 adapted to form a seal with the seal seat 50 defined by the sealing member 40 and extending circumferentially around the sealing member aperture 42.

Activation of the pop-up plug 46 seals the sealing member aperture 42 and prevents fluid flowing from the body inlet 16 to the body outlet 20 along the drainage flowpath 30.

The overflow device 10 further comprises a pipe arrangement 24 in fluid communication with the body 14, the pipe arrangement 24 defining an overflow flowpath 52 between the body inlet 16 and a body outlet 20.

The pipe arrangement 24 is connected the body 14 at a pipe arrangement entry 54, which is in continual fluid communication with the inlet chamber 36, and a pipe arrangement exit 56 which is in continual fluid communication with the outlet chamber 38.

The positioning of the body outlet 20 the water seal 34 extends into the pipe arrangement 24 through the pipe arrangement exit 56. Such an arrangement has a considerable advantage in that the height of the body 14 can be reduced considerably when compared to conventional overflow devices of this nature in which the water seal is below the pipe arrangement.

The body outlet 20 is also positioned such that the water seal 34, which is formed at the height of the outlet lowest level 58, is beneath the body sealing member 40 and, accordingly, the seal between the sealing gasket 48 and the sealing member 40 is above the water seal 34 and, in combination with the displacement of the sealing gasket 48 from the body inlet 16, reduces the undesirable possibility of the water seal being seen 34 from the bath 12.

The pipe arrangement 24 has a lower portion 60 and an upper portion 62, the portions 60, 62 being telescopically arranged. As will be shown, the relative position of the upper and lower portions 60, 62 defines the maximum depth the bath 12 can be filled to before the overflow device 10 acts to prevent the bath 12 from overflowing. The upper portion 62 is an inverted LI-shape which defines an overflow level 68 at which the fluid within the pipe arrangement 24 will flow over the overflow level 68 towards the pipe arrangement exit 56. The upper portion 62 further incorporates an air valve 80, the purpose of which will be discussed with reference to the operation of the overflow device 10.

The operation of the overflow device 10 will now be described with reference to FIGS. 3, 4 and 5.

Figure 3:
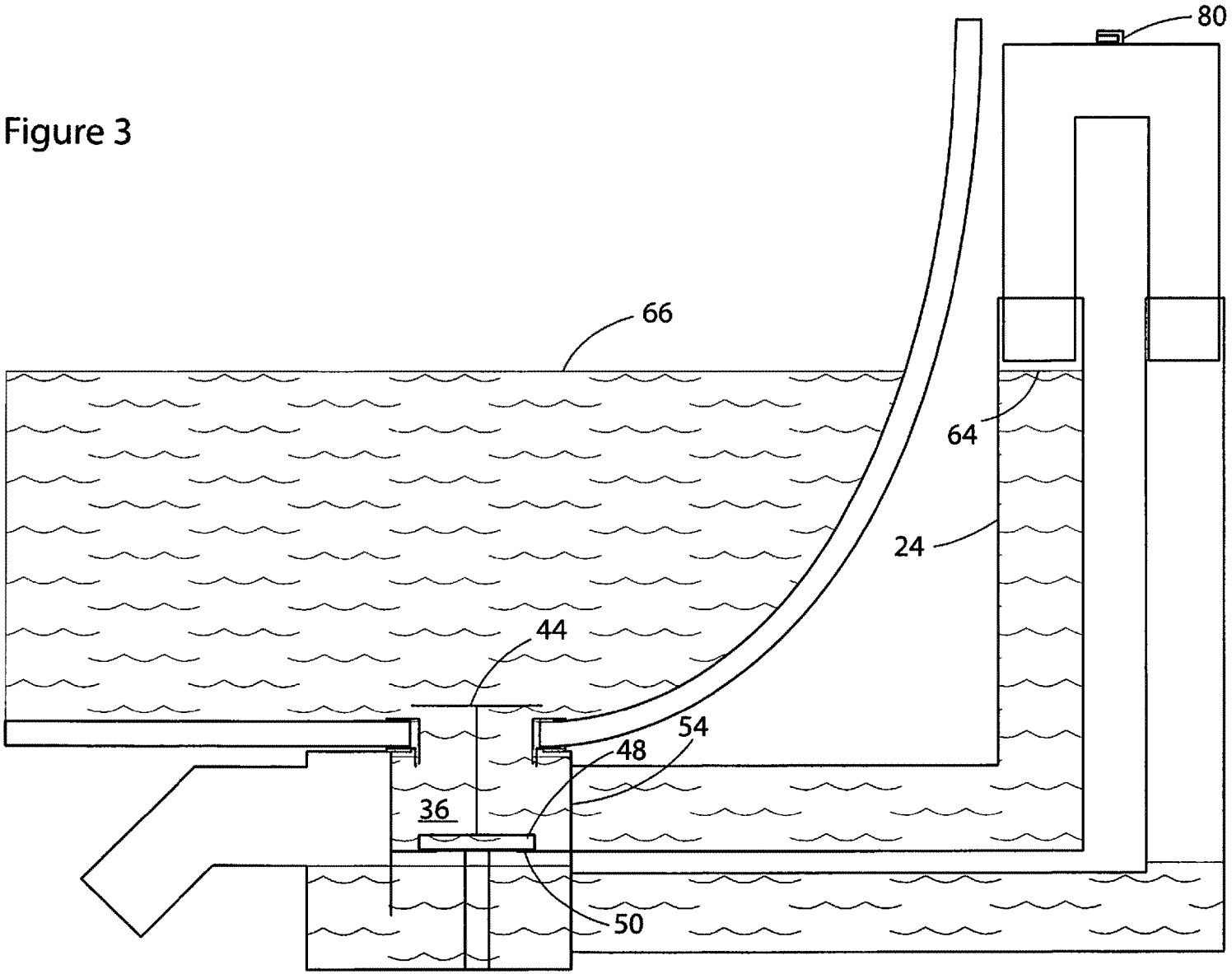
FIG. 3 is a side section schematic of the overflow device of FIG. 1 showing the bath partially filled.

In FIG. 3, the pop-up plug 46 has been activated such that the sealing gasket 48 is sealed against the seal seat 50 defined by the sealing member 40. The bath is then filled from the taps (not shown) and water fills the inlet chamber 36 and flows into the pipe arrangement 24 through the pipe arrangement entry 54 the level of water 64 in the pipe arrangement 24 matching the level of water 66 in the bath 12.

Figure 4:
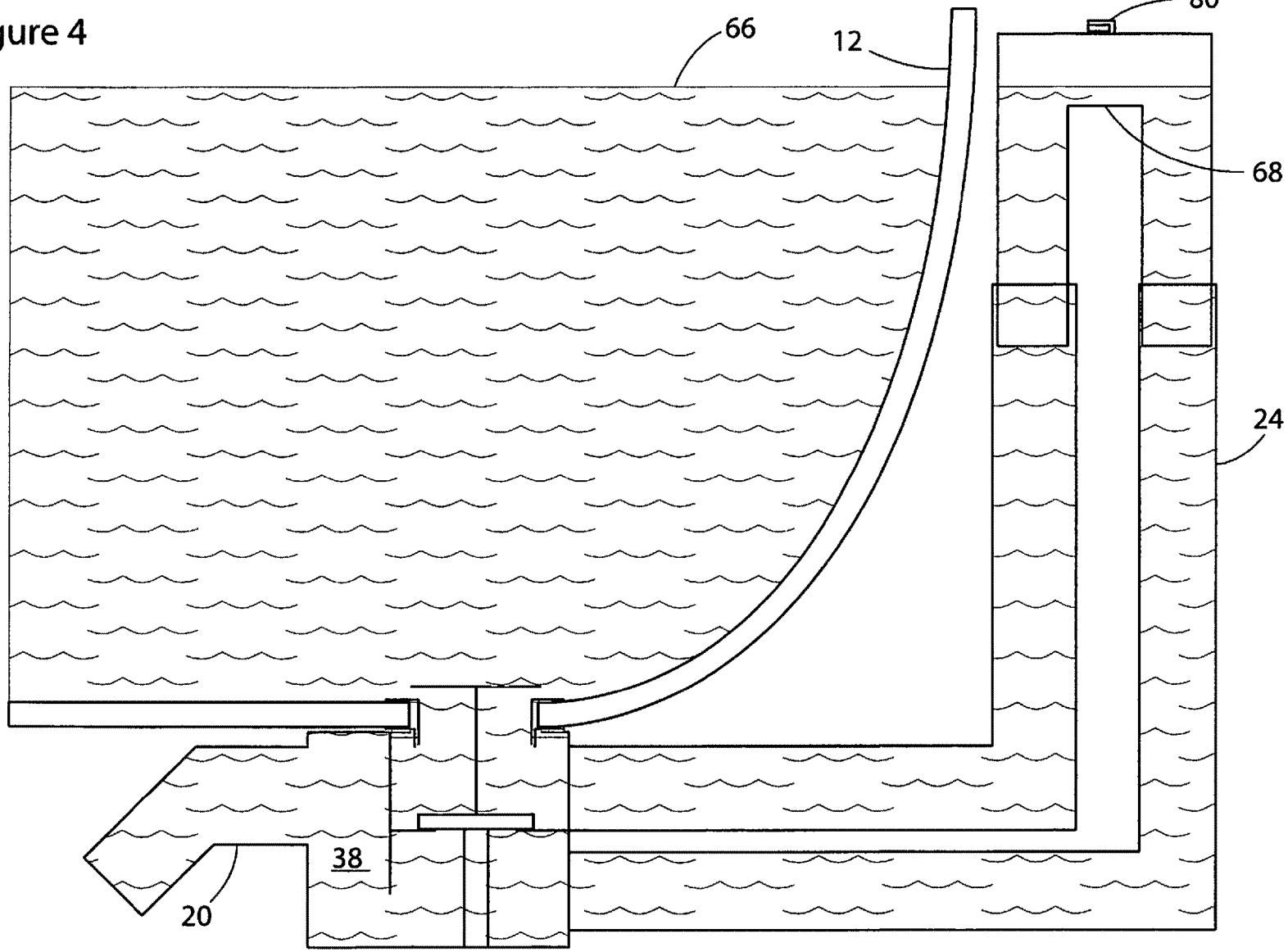
FIG. 4 is a side section schematic of the overflow device of FIG. 1 in an overflow condition.

Referring to FIG. 4, the level of water in the bath 66 has now exceeded the pipe arrangement overflow level 68 and fluid is flowing from the tub 12 through the pipe arrangement 24 into the outlet chamber 38. The outlet chamber is now full and the fluid is flowing through the outlet 20. If the water is flowing into the bath 12 at a higher rate than it is being drained by the overflow 10, air in the upper portion 62 will be driven out through the air valve 80. Once the air is driven out, siphonic flow can be established in the overflow device 10 resulting in much higher flow rates through the overflow device 10, causing the water level 66 to drop.

As the water level 66 in the bath 12 drops towards the overflow level 68, the pipe arrangement air valve 80 admits air into the pipe arrangement 24 breaking the symphonic flow condition and preventing all the water being drained from the bath 12.

Figure 5:
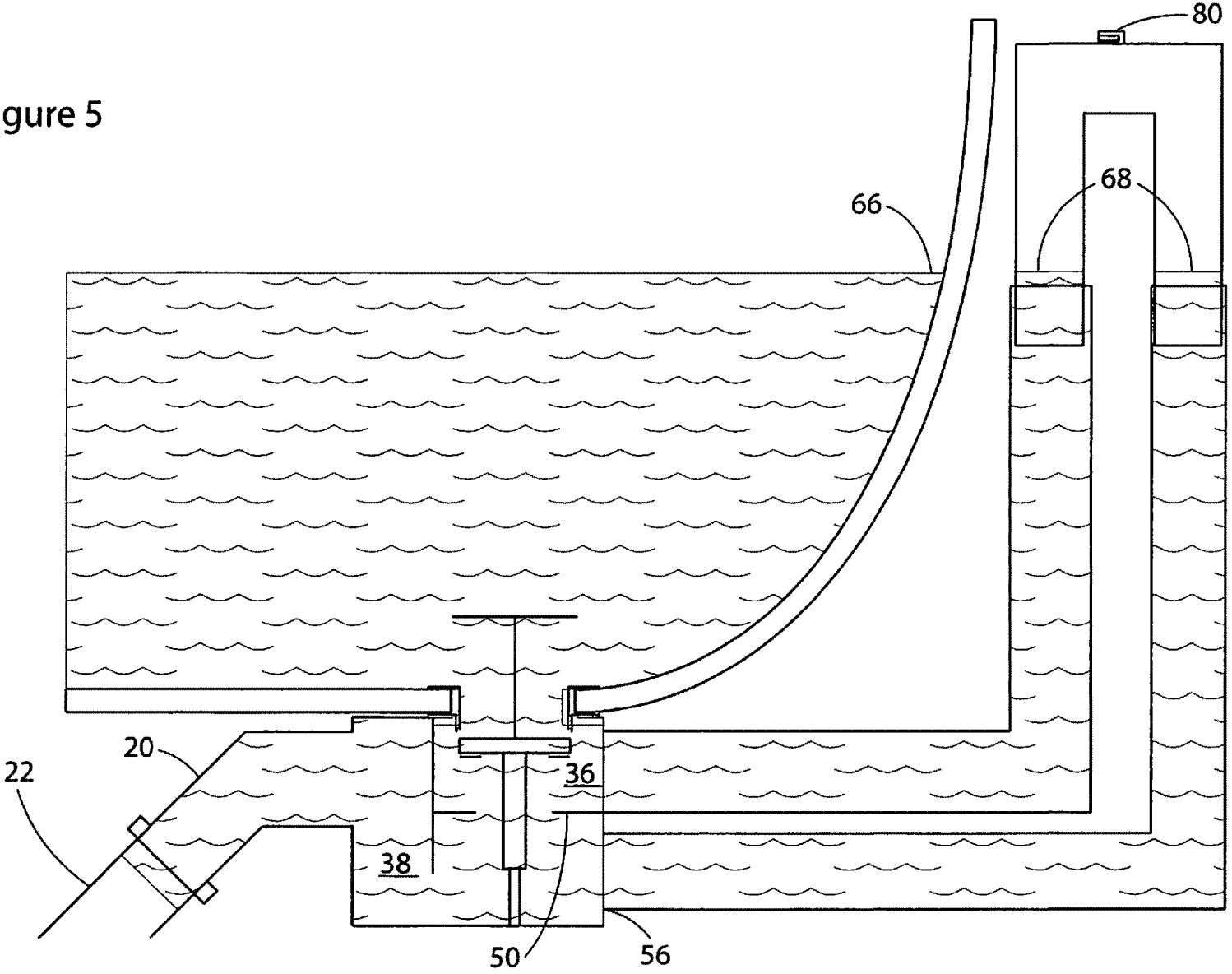
FIG. 5 is a side section schematic of the overflow device of FIG. 1 showing the bath being emptied.

Referring to FIG. 5 when it is desired to empty the bath 12, the pop-up plug 44 is deactivated breaking the seal between the sealing gasket 48 and the seal seat 50. Fluid then flows through the opened drainage flowpath 30 into the outlet chamber 38 and through the outlet 22 the soil stack 22. Due to the pressure on the volume of water in the bath 12, some of the flow well flow into the pipe arrangement through the pipe arrangement exit 56 to equalise the water level 66 on both sides of the pipe arrangement 24.

Once the bath 12 has emptied, the water seal 34 is restored at the level shown in FIG. 1.

Whilst specific embodiments of the present invention have been described above, it will be appreciated that departures from the described embodiments may still fall within the scope of the present invention.

The invention claimed is:

1. An overflow device for a sanitary appliance such as a bathtub, the overflow device comprising:

a body; and a pipe arrangement in fluid communication with the body, the pipe arrangement defining an overflow flowpath;

the body including:

a body inlet located through a top of the body and being configured to be connected to an outlet of the sanitary appliance;

a body outlet located through a side of the body and positioned proximate the top of the body and being configured to be connected to a soil stack;

a separator positioned within the body and located between the body inlet and the body outlet, such that the separator creates a drainage flowpath between the body inlet and the body outlet, wherein the arrangement of the separator relative to the body inlet and the body outlet and the position of the body outlet relative to the top and bottom of the body, is such that, in use, a water seal is created within a lower portion of the body, wherein the water seal has a depth or height defined by the distance between the bottom of the body and a lowest part of the body outlet; and wherein the overflow flowpath between the body inlet and the body outlet, is such that, in use, at least a portion of the overflow flowpath is beneath the water seal.

2. The overflow device as claimed in claim 1, wherein the body comprises an inlet chamber, the inlet chamber being in fluid communication with the body inlet, and an outlet chamber, the outlet chamber being in fluid communication with the body outlet, wherein the pipe arrangement is connected to the body such that a pipe arrangement entry is associated with the inlet chamber and a pipe arrangement exit is associated with the outlet chamber and wherein the pipe arrangement is in continuous fluid communication with the inlet chamber and the outlet chamber.

3. The overflow device as claimed in claim 2, wherein an upper portion of the pipe arrangement defines an inverted U-shaped portion.

4. The overflow device as claimed in claim 3, wherein the inverted U-shaped portion of the pipe arrangement is arranged relative to the sanitary appliance to which it is attached such that fluid level in the pipe arrangement equates to a level of fluid in the sanitary appliance and such that when a predetermined level of water in the sanitary appliance is reached, the inverted U-shaped portion provides an overflow function, wherein fluid flows from the inlet chamber through the pipe arrangement and to the outlet chamber through the pipe arrangement exit.

5. The overflow device as claimed in claim 4, wherein at least part of the pipe arrangement is adjustable such that the predetermined level can be raised or lowered.

6. The overflow device as claimed in claim 5, wherein the pipe arrangement is telescopic.

7. The overflow device as claimed in claim 1, wherein at least a portion of the overflow flowpath is positioned lower than the lowest part of the body outlet.

8. The overflow device as claimed in claim 2, wherein at least a portion of the pipe arrangement exit is positioned lower than the lowest part of the body outlet.

9. The overflow device as claimed in claim 2, further comprising a sealing member, which divides the body and defines the inlet chamber and the outlet chamber, wherein the sealing member includes an aperture, wherein the drainage flowpath is enabled when the aperture is open; and wherein the sealing member includes an edge, which forms a seal seat adapted to cooperate with sealing means operable to close the aperture thereby disabling the drainage flowpath and preventing fluid flow between the inlet chamber and the outlet chamber.

10. The overflow device as claimed in claim 9, wherein the sealing means is configured to be selectively activated from within the sanitary appliance such that when activated part of the sealing means, which is located within the inlet chamber, cooperates with the seal seat to close the aperture such that the sanitary appliance can be filled to a predetermined level and when deactivated the sealing means moves from contact with the seal seat such that the appliance can be emptied.

11. The overflow device as claimed in claim 9, wherein the sealing means comprises a pop-up plug operable from within the sanitary appliance, wherein the pop-up plug incorporates a sealing gasket located within the inlet chamber, wherein the sealing gasket is configured to cooperate with the seal seat to selectively activate and deactivate the sealing function of the sealing means relative to the aperture.

12. The overflow device as claimed in claim 2, wherein the whole of the pipe arrangement exit is positioned lower than the lowest part of the body outlet.

13. An overflow device for a sanitary appliance such as a bathtub, the overflow device comprising:

a body; and a pipe arrangement in fluid communication with the body, the pipe arrangement defining an overflow flowpath;

the body including:

a body inlet located through a top of the body and being configured to be connected to an outlet of the sanitary appliance;

a body outlet located through a side of the body and positioned proximate the top of the body and being configured to be connected to a soil stack;

a separator positioned within the body and located between the body inlet and the body outlet, such that the separator creates a drainage flowpath between the body inlet and the body outlet, wherein the arrangement of the separator relative to the body inlet and the body outlet and the position of the body outlet relative to the top and bottom of the body, is such that, in use, a water seal is created within a lower portion of the body, wherein the water seal has a depth or height defined by the distance between the bottom of the body and a lowest part of the body outlet; and wherein the pipe arrangement defines an overflow flowpath between the body inlet and the body outlet, such that, in use, at least a portion of the overflow flowpath is beneath the water seat, wherein the body comprises an inlet chamber, the inlet chamber being in fluid communication with the body inlet, and an outlet chamber, the outlet chamber being in fluid communication with the body outlet, wherein the pipe arrangement is connected to the body such that a pipe arrangement entry is associated with the inlet chamber and a pipe arrangement exit is associated with the outlet chamber and wherein the pipe arrangement is in continuous fluid communication with the inlet chamber and the outlet chamber, and wherein at least a portion of the overflow flowpath is positioned lower than e lowest part of the body outlet.

14. The overflow device as claimed in claim 13, further comprising a sealing member, which divides the body and defines the inlet chamber and the outlet chamber, wherein the sealing member includes an aperture, wherein the drainage flowpath is enabled when the aperture is open; and wherein the sealing member includes an edge, which forms a seal seat adapted to cooperate with sealing means operable to close the aperture thereby disabling the drainage flowpath and preventing fluid flow between the inlet chamber and the outlet chamber.

15. The overflow device as claimed in claim 13, wherein at least a portion of the pipe arrangement exit is positioned lower than the lowest part of the body outlet.

16. The overflow device as claimed in claim 13, wherein the whole of the pipe arrangement exit is positioned lower than the lowest part of the body outlet.

17. An overflow device for a sanitary appliance such as a bathtub, the overflow device comprising:

a body; and a pipe arrangement in fluid communication with the body, the pipe arrangement defining an overflow flowpath;

the body including:

a body inlet located through a top of the body and being configured to be connected to an outlet of the sanitary appliance;

a body outlet located through a side of the body and positioned proximate the top of the body and being configured to be connected to a soil stack; and a separator positioned within the body and located between the body inlet and the body outlet, such that the separator creates a drainage flowpath between the body inlet and the body outlet, wherein the arrangement of the separator relative to the body inlet and the body outlet and the position of the body outlet relative to the top and bottom of the body, is such that, in use, a water seal is created within a lower portion of the body, wherein the water seal has a depth or height defined by the distance between the bottom of the body and a lowest part of the body outlet, wherein the overflow flowpath between the body inlet and the body outlet, is such that, in use, at least a portion of the overflow flowpath is beneath the water seal, wherein the body comprises an inlet chamber, the inlet chamber being in fluid communication with the body inlet, and an outlet chamber, the outlet chamber being in fluid communication with the body outlet, wherein the pipe arrangement is connected to the body such that a pipe arrangement entry is associated with the inlet chamber and a pipe arrangement exit is associated with the outlet chamber and wherein the pipe arrangement is in continuous fluid communication with the inlet chamber and the outlet chamber, and wherein an upper portion of the pipe arrangement defines an inverted U-shaped portion.

18. The overflow device as claimed in claim 17, further comprising a sealing member, which divides the body and defines the inlet chamber and the outlet chamber, wherein the sealing member includes an aperture, wherein the drainage flowpath is enabled when the aperture is open; and wherein the sealing member includes an edge, which forms a seal seat adapted to cooperate with sealing means operable to close the aperture thereby disabling the drainage flowpath and preventing fluid flow between the inlet chamber and the outlet chamber.

19. The overflow device as claimed in claim 17, wherein at least a portion of the pipe arrangement exit is positioned lower than lowest part of the body outlet.

20. The overflow device as claimed in claim 17, wherein the whole of the pipe arrangement exit is positioned lower than the lowest part of the body outlet.

* * * * *